United States Patent [19]

Waite

[11] 4,314,392

[45] Feb. 9, 1982

[54] METHOD OF MAKING A SPARK PLUG ELECTRODE

[75] Inventor: John S. Waite, Welshpool, Wales

[73] Assignee: GKN Floform Limited, Great Britain

[21] Appl. No.: 100,411

[22] Filed: Dec. 5, 1979

[30] Foreign Application Priority Data

Dec. 16, 1978 [GB] United Kingdom ..... 48817/78

[51] Int. Cl.[3] ..... H01T 13/20

[52] U.S. Cl. ..... 29/25.12; 313/141

[58] Field of Search ..... 72/258; 313/141; 29/25.18, 25.12; 228/155

[56] References Cited

U.S. PATENT DOCUMENTS

| | | | |
|---|---|---|---|
| 2,955,222 | 10/1960 | Beesch | 313/141 |
| 3,803,892 | 4/1974 | Yamaguchi et al. | 29/25.12 |
| 3,857,145 | 12/1974 | Yamaguchi et al. | 313/141 |

FOREIGN PATENT DOCUMENTS

| | | | |
|---|---|---|---|
| 754591 | 8/1956 | United Kingdom | 29/25.12 |
| 1425126 | 2/1976 | United Kingdom | 29/25.12 |

*Primary Examiner*—John McQuade

*Attorney, Agent, or Firm*—Merriam, Marshall & Bicknell

[57] ABSTRACT

A method of making a center electrode for a spark plug comprising uniting together, by heating and without the use of brazing materials, slugs of copper and nickel alloy and then extruding the united slugs to form a central electrode having a copper core and a nickel alloy sheath.

3 Claims, 7 Drawing Figures

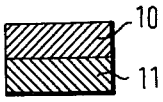
FIG. 1.
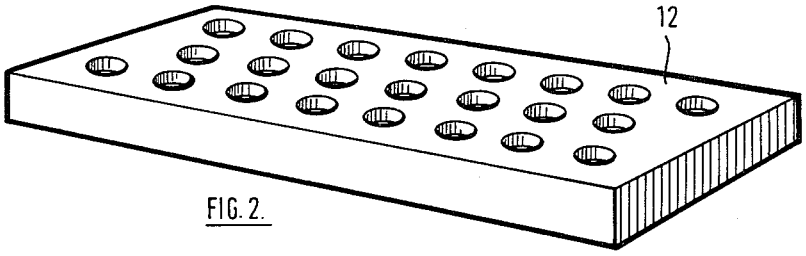
FIG. 2.
FIG. 3.
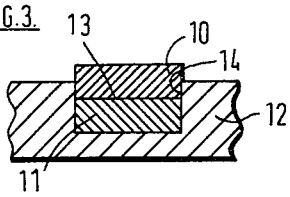
FIG. 4.
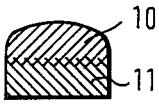
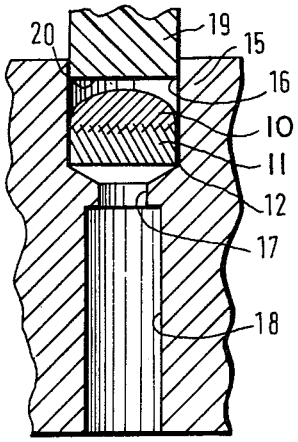
FIG. 5.
FIG. 6.
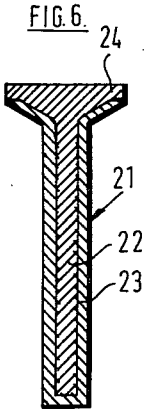
FIG. 7.
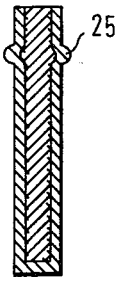

METHOD OF MAKING A SPARK PLUG ELECTRODE

This invention relates to a method of producing the centre electrode of a spark plug. More specifically, the invention is concerned with the production of a centre electrode having a core of a metal which has good thermal conductivity, e.g. copper, and a sheath of a corrosion resistant material such as nickel or nickel alloy.

It has previously been proposed for example in British Pat. No. 754591, to produce such an electrode by brazing together slugs of copper and nickel and then extruding the joined slugs to form an electrode having a copper core and a nickel sheath. We have found that when using a nickel-iron-chromium alloy such as Inconel 600 (Registered Trade Mark) for the sheath the braze metal does not wet the nickel alloy so that voids occur at the brazed joint. Upon subsequent extrusion of the joint slugs the nickel alloy sheath cracks at the voids produced during brazing.

It has also been proposed in British Pat. No. 1425126 to produce an electrode from slugs of copper and nickel wherein the copper slug has a head and a cylindrical shaft which fits within a corresponding recess in the nickel slug prior to extrusion of the two slugs into the electrode. Furthermore it is suggested that the two slugs may be joined together for example by soldering or welding but such an arrangement would suffer from the disadvantage mentioned above when utilising a nickel-iron-chromium alloy in that voids may occur at the interface with the copper.

It is an object of the invention to provide an improved method whereby one can make an electrode with a core of a metal of high thermal conductivity e.g. copper, with a sheath of corrosion resistant material, e.g. a nickel alloy of the type mentioned above.

According to the invention we provide a method of making a central electrode for a spark plug comprising superposing slugs of first and second metals having the qualities hereinafter defined with faces of the slugs in direct contact as an interface, heating the portion of the slug of the first metal adjacent said interface mainly by conduction of heat from the slug of the second metal across said interface until said portion melts, cooling the slugs so that they are united at the interface, and extruding the united slugs to produce an elongated electrode comprising a core of the first metal within a sheath of the second metal.

The first and second metals are to have the following defined properties. The first metal which forms the core is to have a thermal conductivity higher than that of the second metal and a melting point lower than that of the second metal. The second metal is to be resistive to the corrosive environment in which the electrode works.

The first or core metal will usually be oxygen-free copper although silver could be used if desired. The second of sheath metal will usually be a nickel, iron, chromium alloy as described above.

Preferably the method is carried out so that the heating of the slugs takes place in a radiant furnace with the slugs positioned in a pocket in a black body, the slug of the second metal and the interface being positioned wholly within the pocket and the slug of the first metal projecting from the pocket.

Preferably, the method includes the step of forming the slugs of at least one of the metals of wire by cropping the wire into short lengths and then cold forming these lengths into the required slugs. Preferably the slugs of both metals are made in this way.

After extrusion, an enlarged head is left attached to the electrode, the head being formed mainly of the first or core metal. The method preferably includes the step of removing this head and then cold forming the electrode to form a shoulder thereon adjacent to the end thereof from which the head has been removed.

The invention will now be described in detail by way of example with reference to the accompanying diagrammatic drawings in which:

FIG. 1 is a section through superposed slugs of copper and nickel alloy,

FIG. 2 is a perspective view of a pocketed black body in which the slugs can be fused together;

FIG. 3 is a section through the black body of FIG. 2 showing the slugs in position;

FIG. 4 is a section through the slugs fused together;

FIG. 5 is a section showing the slugs in an extrusion machine prior to extrusion;

FIG. 6 is a section through the extruded electrode blank; and

FIG. 7 is a section through the completed electrode.

Referring now to FIG. 1, an electrode is made from superposed slugs of first and second metals. The upper slug in the present example is indicated at 10 and is made of commercially-pure, oxygen-free copper. The lower slug 11 is made of Inconel 600 (Registered Trade Mark) which is a nickel-iron-chromium alloy having a typical composition, in parts by weight, of chromium 14.7%–17.0%; iron 6.0%–10.0%; manganese 1.0% maximum; silicon 0.5% maximum; carbon 0.15% maximum; copper 0.5% maximum and nickel balance. In some forms the alloy may also include cobalt.

Preferably the slugs have been made from wire of the appropriate materials of slightly smaller diameter than the diameter of the cylindrical slugs required. The wire is cropped into short lengths and is then cold headed to form the necessary slugs.

The slugs are then degreased in a conventional manner.

Pairs of slugs are then placed in a pocketed black body 12 as shown in FIG. 2. This body is preferably made of graphite. FIG. 3 shows that the pair of slugs, when inserted in the pocket in the body, have the nickel alloy slug 11 wholly contained within the pocket with the copper slug 10 projecting from the pocket. The interface 13 between the slugs is located within the pocket. The slugs engage one another directly at the interface, there is no plating or brazing material or the like.

The black body 12 with its load of slugs is then passed through a radiant furnace with a reducing atmosphere. The black body 12 will heat at a faster rate than the copper slug 10 so that the slug 10 will be heated mainly by conduction from the black body and from the nickel slug 11. This means that the portions of the copper slug 10 adjacent the interface 13 will melt and due to capillary action will wet the face of the nickel alloy slug 11. The slugs are then cooled and the copper slug will be found to have become united to the nickel alloy slug 11 at the interface 13.

It will be apparent that it is necessary to control the temperature closely in the furnace and to control the rate at which the black body moves through the furnace to ensure that the fusion takes place. Preferably the remainder of the copper slug is not allowed to melt but, if it does, it will be retained in position by the pocket 14 in the black body in which the slugs are retained during heating.

FIG. 4 is a section through the united slugs and it will be seen that the upper surface of the copper slug has slightly drooped around its periphery.

FIG. 5 shows the combined slugs in an extrusion machine comprising an extrusion die 15 having an upper cavity 16, an extrusion nozzle 17 and a clearance space 18. The extrusion punch 19 has a flat end face 20. The punch pushes the slug through the nozzle 17 so that one ends up with an elongated body as shown in FIG. 6. This body is indicated generally at 21 and is in the form of a copper core 22 within a nickel alloy sheath 23. There is an enlarged head 24 which has not passed through the extrusion nozzle 17 and which is formed largely of copper.

This head is subsequently removed and the elongated electrode is cold headed to produce a shoulder 25 as shown in FIG. 7 which enables the electrode to be mounted in a spark plug body.

We claim:

1. A method of making a centre electrode for a spark plug comprising the steps of superposing slugs of first and second metals with faces of the slugs in direct contact at an interface, said first metal having a thermal conductivity higher than that of said second metal and a melting point lower than that of said second metal, said second metal being resistive to the corrosive environment in which the electrode works; heating the superposed slugs in a radiant furnace wherein the superposed slugs are positioned in a pocket in a black body, the slug of said second metal being positioned wholly within the pocket and the slug of said first metal projecting from the pocket, a portion of the slug of said first metal adjacent said interface being heated mainly by conduction of heat from the slug of said second metal across said interface until said portion melts; cooling the slugs so that they are united at said interface and extruding the united slugs to produce an elongated electrode comprising a core of said first metal within a sheath of said second metal.

2. A method according to claim 1 including the step of forming the slugs of at least one of the metals from wire by cropping the wire into short lengths and then cold forming the lengths into slugs.

3. A method according to claim 1 wherein, after extrusion of the combined slugs, an enlarged head is left attached to the extruded electrode, the method including removing the head and then cold forming the electrode to form a shoulder thereon adjacent to the end thereof from which the head has been removed.

* * * * *

UNITED STATES PATENT AND TRADEMARK OFFICE

CERTIFICATE OF CORRECTION

PATENT NO. : 4,314,392

DATED : February 9, 1982

INVENTOR(S) : John Stuart Waite and Kenneth Howard

It is certified that error appears in the above-identified patent and that said Letters Patent is hereby corrected as shown below:

On the cover in item "[75]", after "John S. Waite" insert

-- and Kenneth Howard, both of --

In item (19) "Waite" should read -- Waite et al --.

Signed and Sealed this

*Twelfth* Day of *November 1985*

[SEAL]

*Attest:*

DONALD J. QUIGG

*Attesting Officer*

*Commissioner of Patents and Trademarks*